US005522411A

United States Patent [19]

Johnson

[11] Patent Number: 5,522,411

[45] Date of Patent: Jun. 4, 1996

[54] HAND WASHING AND DRYING EQUIPMENT UNIT

[76] Inventor: Gloria A. Johnson, 158 Easton Ave., Buffalo, N.Y. 14215

[21] Appl. No.: 268,305

[22] Filed: Jun. 30, 1994

[51] Int. Cl.[6] ..... B08B 3/02

[52] U.S. Cl. ..... 134/95.2; 4/619; 4/628; 4/630; 4/638; 134/44; 134/104.2; 134/107; 134/198

[58] Field of Search ..... 4/619, 628, 630, 4/638, 653; 604/289; 134/44, 50, 95.2, 99.2, 102.3, 104.2, 107, 198, 199, 200; 222/181.3, 185.1

[56] References Cited

U.S. PATENT DOCUMENTS

| | | | |
|---|---|---|---|
| 4,144,596 | 3/1979 | MacFarlane et al. | 4/628 X |
| 4,336,619 | 6/1982 | Hinkel et al. | 4/619 |
| 4,670,010 | 6/1987 | Dragone | 604/289 |
| 4,942,631 | 7/1990 | Rosa | 4/623 |
| 5,074,322 | 12/1991 | Jaw | 134/102.3 X |
| 5,186,360 | 2/1993 | Mease et al. | 222/63 |
| 5,199,118 | 4/1993 | Cole et al. | 4/619 |
| 5,265,628 | 11/1993 | Sage et al. | 134/58 R |

FOREIGN PATENT DOCUMENTS

| | | | |
|---|---|---|---|
| 923011 | 4/1963 | United Kingdom | 4/628 |

*Primary Examiner*—Philip R. Coe
*Attorney, Agent, or Firm*—Bean, Kauffman & Spencer

[57] ABSTRACT

A portable hand washing and drying equipment unit comprises a housing having a front hand receiving opening communicating with a central hand compartment. Adjacently above the hand compartment is an upper compartment having a cleansing liquid reservoir with a valve-controlled flow tube for selectively delivering cleansing liquid from the reservoir to the hand compartment, and an electrically powered fan for providing a flow of hand drying air within the hand compartment. The reservoir and fan are supported by a shelf which is slidable into and out of the housing to enable access to such elements. Adjacently below the hand compartment is a lower compartment having a removable waste liquid receptacle therein for temporarily storing used cleansing liquid.

14 Claims, 2 Drawing Sheets

FIG. 1
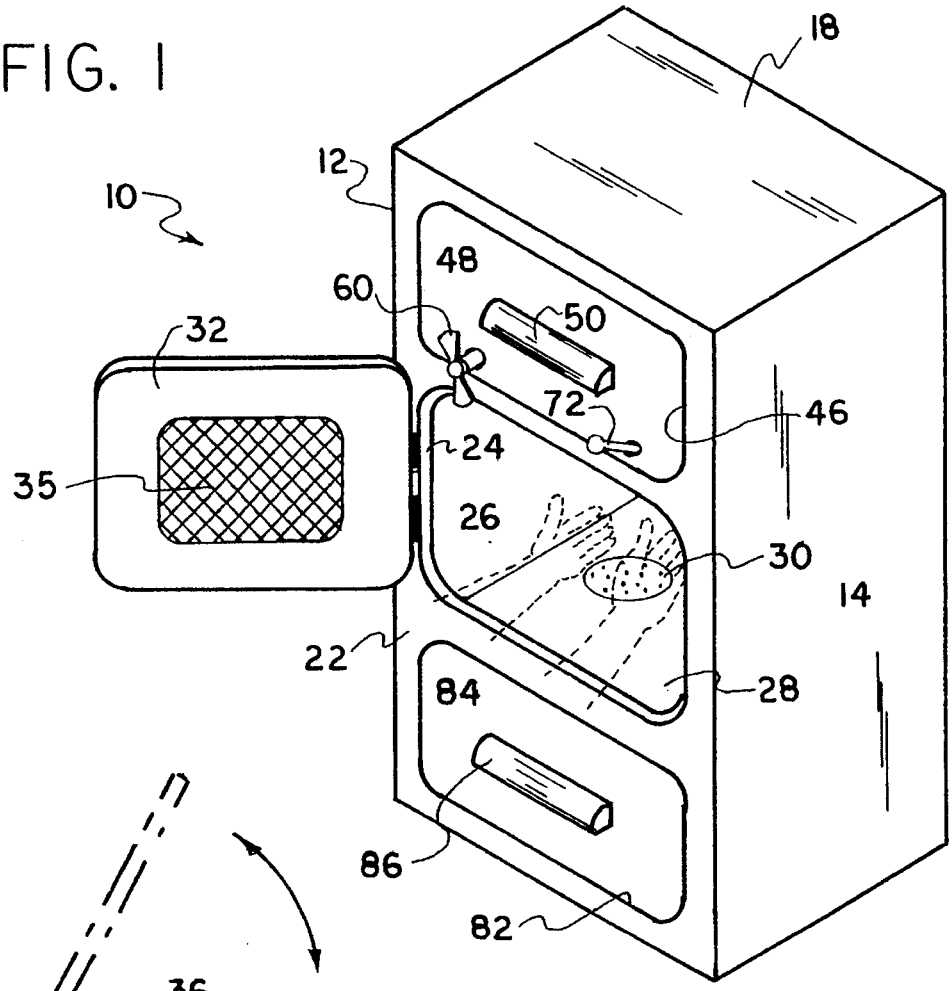
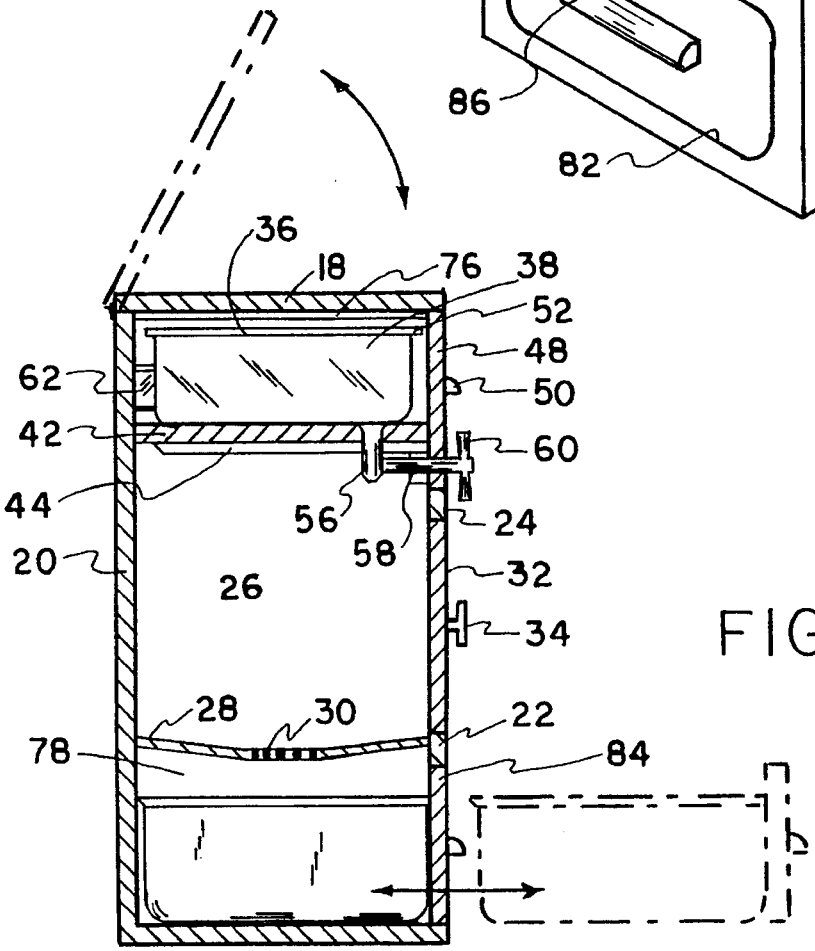
FIG. 2

HAND WASHING AND DRYING EQUIPMENT UNIT

BACKGROUND OF THE INVENTION

1. Field of the Invention

This invention relates to equipment used for sequentially washing and drying one's hands, and more particularly to a portable, self-contained hand washing and drying equipment unit.

2. Description of the Prior Art

It is well known to provide soap dispensing means and hand drying means proximate a conventional lavatory water faucet and basin, whereby a user may dispense soap and water onto his or her hands to wash the hands, rinse the hands under running water from the faucet, and dry the hands. Additionally, various devices have been introduced for providing similar hand washing and drying functions.

One such device, invented by Hinkel et al. and disclosed in U.S. Pat. No. 4,336,619, is a wall-mounted device having a bowl defining a hand washing and drying space and integral means on the bowl for supplying soap, water, and hand drying air to the bowl. The device is disclosed as being permanently connected to the water supply and sewage system of a building, and includes a housing having a removable front panel for providing limited access to elements enclosed thereby. The device must be connected to a standard 120 Volt alternating current outlet to power an air blower provided in the device.

U.S. Pat. No. 4,942,631 to Rosa describes a hand sanitizing station having a sink mounted on a plumbing cabinet with a spray manifold mounted above the sink for spraying a sanitizing solution and clear water rinse. The spray manifold is operable by an infrared proximity switch, and the cabinet includes a hinged front door for providing access to elements therein. However, the station lacks integral means for drying hands and is designed to be permanently connected to the plumbing lines of a building. A pump located in the plumbing cabinet and the infrared switch are electrically powered by connection to a standard 120 Volt AC outlet.

Another prior art hand washing and drying device is a wall-mounted station disclosed in U.S. Pat. No. 5,199,118 to Cole et al. Similar to the aforementioned devices of Hinkel et al. and Rosa, the device of Cole et al. is designed for permanent connection to the plumbing lines of a building and operates from a standard 120 Volt AC outlet.

Where limitations exist with regard to wall space, access to plumbing lines, and/or access to an electrical power outlet, or where portability is desired, prior art hand washing and drying devices may be unsuitable for use. For instance, in a typical barber shop or hair salon, it may be desirable to have hand washing and drying equipment conveniently located on a countertop proximate a barber chair or styling station to enable a barber or hair stylist to practice safe hygiene between operations without having to leave a customer to visit a separate wash room. Other settings wherein prior art devices may be unsuitable include laboratories, professional offices, schools, vehicles, and boats.

SUMMARY OF THE INVENTION

The present invention is directed to an improved hand washing and drying equipment unit which is portable for convenient placement on a table or counter top, or which may be easily mounted on a room wall without need to permanently connect the unit to building plumbing lines.

The unit comprises a housing having a central hand compartment, an upper compartment, and a lower compartment. A hand receiving opening is provided through a front wall of the housing for communication with the hand compartment, which includes a bottom drain board having a drain opening communicating with the lower compartment.

The upper compartment includes a cleansing liquid reservoir preferably containing a no-rinse cleansing liquid and having a flow tube and valve for selectively delivering cleansing liquid from the reservoir to the hand compartment under the force of gravity, and air flow means, such as a battery powered fan or blower, for providing a flow of hand drying air within the hand compartment. A valve control and switch for the fan or blower are provided on the exterior of the housing proximately above the hand receiving opening for controlling the flow of cleansing liquid and hand drying air, respectively. The reservoir and air flow means are preferably supported by a shelf which is slidably mounted for movement into and out of the housing to enable access to such elements for maintenance purposes. An alternative feature for enabling access to elements stored within the upper compartment is a hinged top wall on the housing.

The lower compartment includes a removable waste liquid receptacle arranged to receive and temporarily store used cleansing liquid which is channeled by the drain board through the drain opening and into the lower compartment.

BRIEF DESCRIPTION OF THE DRAWING

The nature and mode of operation of the present invention will now be more fully described in the following detailed description of the preferred embodiments taken with the accompanying drawing figures, in which:

FIG. 1 is a perspective view of a hand washing and drying equipment unit formed in accordance with the present invention;

FIG. 2 is a left side sectional view thereof showing an alternate position of the top wall and an alternate position of the waste liquid receptacle of the present invention;

DESCRIPTION OF THE PREFERRED EMBODIMENTS

Figure 3:
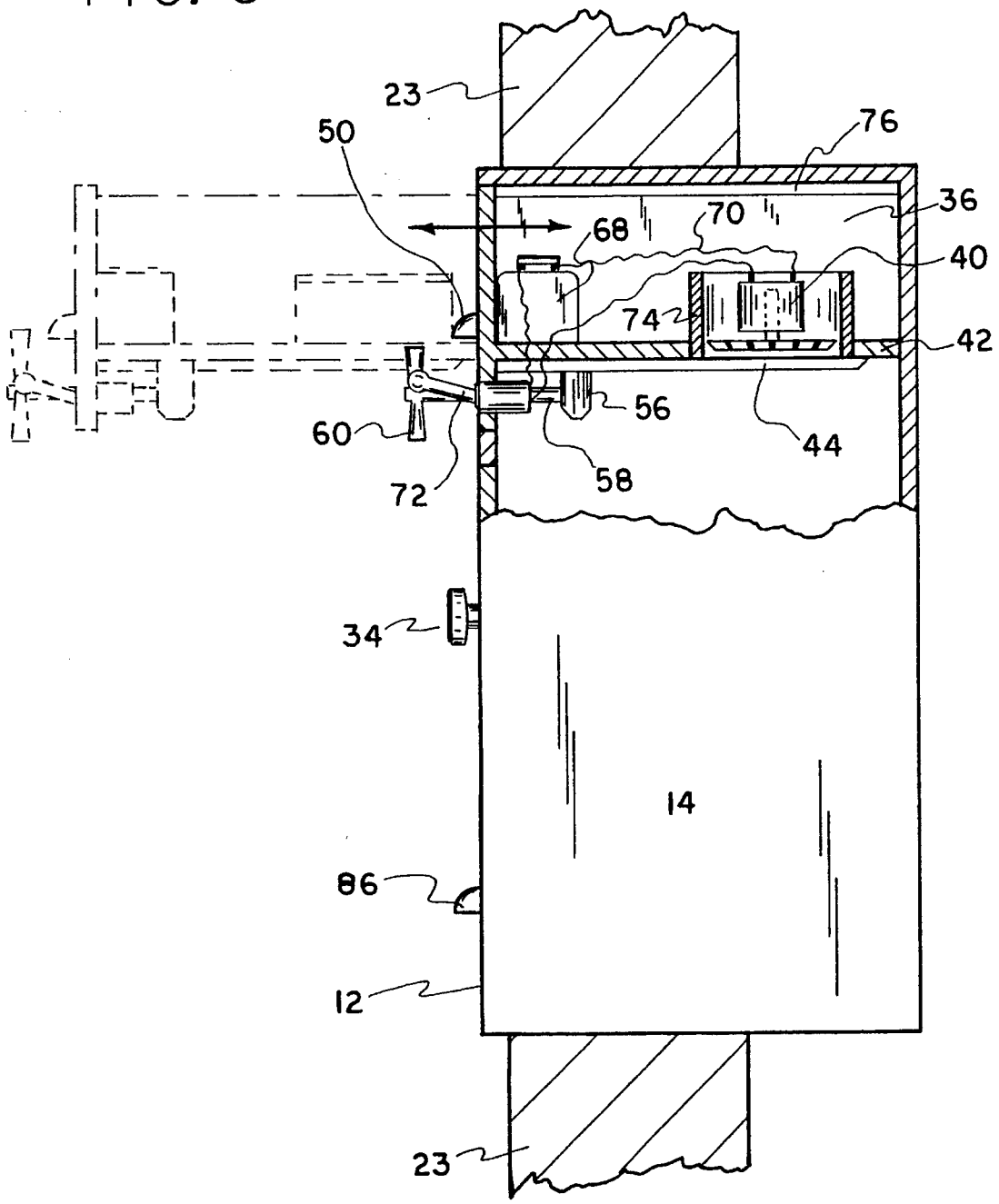
FIG. 3 is a right side sectional view thereof showing the unit of the present invention mounted to extend behind a room wall surface and further showing an alternate position of the slidable shelf and elements supported thereby.

Referring to FIGS. 1 through 3, a hand washing and drying equipment unit according to the present invention is indicated generally at 10. Unit 10 comprises a housing 12 having a pair of opposing spaced side walls 14, a bottom wall 16, a top wall 18, a rear wall 20, and a front wall 22. The dimensions of housing 12 are preferably chosen to provide a suitably sized, space efficient unit which may be conveniently located on a table or counter top, or mounted on a room wall using conventional means, such that rear wall 20 is flush against the room wall. As depicted in FIG. 3, unit 10 may also be mounted within a cut-out opening in a room wall 23 such that the depth of housing 12 extends behind the surface of the room wall. Housing 12 is preferably constructed of an aesthetically pleasing material, such as finished wood, selected with appropriate consideration of the interior design scheme of the room in which it will be used. Other materials, including plastics and stainless steel, are contemplated.

A hand-receiving opening 24 is provided in front wall 22 to allow a user to insert his or her hands into a hand compartment 26 defined by housing 12. Hand compartment 26 is generally located in a vertically central position between top wall 18 and bottom wall 16, and includes a bottom drain board 28 mounted below hand receiving opening 24 and having a drain opening 30 therein. A hinged door 32 having a handle or knob 34 covers hand receiving opening 24 while unit 10 is not in use, and is preferably provided with a mesh or screen portion 35 to facilitate air circulation within hand compartment 26 while door 32 is closed. Door 32 may also be mounted on front wall 22 for horizontal sliding movement relative to hand receiving opening 24.

Adjacently above hand compartment 26 in housing 12 is an upper compartment 36 wherein a cleansing liquid reservoir 38 and an electric fan 40 are supported by a horizontal shelf 42. In a preferred form of the invention, shelf 42 is slidably mounted on a pair of horizontally arranged tracks 44, fixed one on each side wall 14, for horizontally directed movement into and out of housing 12 through an upper opening 46 in front wall 22, thereby enabling easy access to elements contained within upper compartment 36, particularly where unit 10 is mounted to extend behind room wall 23 as illustrated in FIG. 3. A vertical portion 48 of shelf 42 is adapted to close or cover upper opening 46 when shelf 42 is fully inserted into housing 12 and includes an outer handle 50 thereon. As an additional or alternative means of enabling access to upper compartment 36, top wall 18 may be connected to housing 12 by hinges, whereby the top wall may be moved to an open position as depicted in FIG. 2.

Cleansing liquid reservoir 38 may be any leak-proof container suitable for holding liquid, such as a plastic tub, which fits conveniently within upper compartment 36. Reservoir 38 includes a removable seal or cover 52 for permitting necessary refill of the reservoir with a cleansing liquid. It is also contemplated that reservoir 38 be integrally formed with shelf 42, particularly for instance where shelf 42 is formed from plastic. The shape of reservoir 38 may be chosen to maximize the capacity thereof within space constraints of upper compartment 36.

Reservoir 38 is provided with a flow tube 56 extending downward from the bottom of the reservoir, through shelf 42, and into hand compartment 26, and a valve 58 extending through vertical portion 48 for controlling the flow of cleansing liquid through the flow tube, whereby a user may selectively deliver cleansing liquid from the reservoir to hand compartment 26 by rotation of an externally accessible valve control 60. While the illustrated flow tube and valve system provides a simple means for delivering cleansing liquid from reservoir 38 to hand compartment 26, other liquid delivery means may be employed without straying from the spirit or scope of the present invention.

To avoid the need for rinse water from an external source or building water line, cleansing liquid stored within reservoir 38 may be of a "no-rinse" variety, for instance a dilute mixture of water and soap, or other sterilizing chemical. Where it is desirable to provide cleansing liquid at an elevated temperature, a conventional AC powered heating element 62 may be situated within upper compartment 36 proximate or in contact with reservoir 38 to effect heat transfer to cleansing liquid stored therein.

Electric fan 40, powered by a DC battery 68 connected thereto by wires 70 and controlled by an externally accessible switch 72, also resides within upper compartment 36 and communicates with hand compartment 26 through a fan duct 74 extending through shelf 42 to provide a flow of hand drying air within the hand compartment. Fan 40 and battery 68 are preferably separated from reservoir 38 by a liquid resistant, electrically insulated barrier 76, which protects electrical elements within upper compartment 36 from inadvertent spillage of cleansing liquid during refill of reservoir 38 and shields a user from electrical shock. While the specifications of fan 40 and battery 68 are not critical, the air flow provided within hand compartment 26 should be sufficient to effectively dry wet hands within a reasonably short period of time. Alternative means of providing a flow of hand drying air, not shown, include the use of a fan or hot air blower operating from a standard 120 Volt AC power outlet and connected thereto by a power cord conveniently arranged to extend through a cord opening in housing 12, for instance through rear wall 20.

Adjacently below hand compartment 26 in housing 12 is a lower compartment 78 containing a waste liquid receptacle 80. Receptacle 80 is sized to be removable through a lower opening 82 provided in front wall 22, and includes a face portion 84 complementary in shape to lower opening 82 with a handle 86 thereon to assist in removal from and replacement of receptacle 80 within lower compartment 78. Receptacle 80 may be a plastic tub or the like preferably having a capacity equal to or greater than reservoir 38 and being arranged to receive used cleansing liquid flowing through drain opening 30.

To wash hands using the present invention, a user opens door 32, places a first hand through hand receiving opening 24 and into hand compartment 26, and uses a second hand to operate valve control 60, thereby opening valve 58. When valve 58 is open, cleansing liquid flows under the force of gravity from reservoir 38 through flow tube 56 and into hand compartment 26, where it may be caught by the first hand; when a sufficient quantity of cleansing liquid has been delivered, the user again operates valve control 60 to close valve 58 and halt the flow of cleansing liquid. The user then places the second hand within hand compartment 26 and scrubs both hands together with the cleansing liquid. Used cleansing liquid is allowed to fall to drain board 28, which channels the waste liquid to drain opening 30, through which it passes under the force of gravity to receptacle 80. When scrubbing is complete, the user momentarily withdraws either hand from the hand compartment and operates fan switch 72 to activate fan 40. The user may then allow the air flow provided by fan 40 within hand compartment 26 to dry both hands. When the hands are sufficiently dry, the user removes them from hand compartment 26, closes door 32, and operates fan switch 72 to shut off fan 40.

To maintain a suitable level of cleansing liquid within reservoir 38, a user refills the reservoir by pulling handle 50 to slide shelf 42 outward from housing 12 or lifting hinged top wall 18 to expose the reservoir, removing reservoir cover 52, pouring pre-mixed cleansing liquid into the reservoir, replacing cover 52, and returning shelf 42 or top wall 18 to its original closed position.

To empty waste liquid collected in receptacle 80, a user simply withdraws the receptacle from lower compartment 78 using handle 78 and pours the waste liquid from the receptacle into a sewage drain or the like. Receptacle 80 may then be replaced within lower compartment 70 for further use.

What is claimed is:

1. A hand washing and drying equipment unit comprising:

an external housing, said housing including a pair of spaced side walls, a rear wall, and a front wall cooperating to define an interior hand compartment, said front wall having a hand-receiving opening communicating with said hand compartment;

a cleansing liquid reservoir mounted within said housing and means for selectively delivering cleansing liquid from said reservoir to said hand compartment;

electrically powered air flow means mounted within said housing for selectively providing a flow of air within said hand-wash compartment to dry hands received therein;

support means for mounting said cleansing liquid reservoir and said air flow means within said housing, said support means being slidably mounted in said housing for horizontally directed movement into and out of said housing for enabling access to said cleansing liquid reservoir and said air flow means; and a waste liquid receptacle beneath said hand compartment for storing used cleansing liquid, said hand compartment opening downwardly toward said receptacle.

2. A unit according to claim 1, wherein said cleansing liquid reservoir contains no-rinse cleansing liquid.

3. A unit according to claim 2, wherein said cleansing liquid reservoir is refillable.

4. A unit according to claim 2, wherein said cleansing liquid reservoir includes means for heating said cleansing liquid.

5. A unit according to claim 1, wherein said cleansing liquid reservoir is mounted above said hand compartment and said means for delivering cleansing liquid includes a flow tube extending from said reservoir to said hand compartment and a control valve for controlling the flow of cleansing liquid through said flow tube, whereby cleansing liquid may be selectively delivered to said hand compartment under the force of gravity.

6. A unit according to claim 5, wherein said housing further includes a hinged top wall for enabling access to said cleansing liquid reservoir and said air flow means.

7. A unit according to claim 1, wherein said hand compartment includes a bottom drain board having a drain opening therein to permit drainage of used cleansing liquid from said hand compartment to said receptacle.

8. A unit according to claim 1, further including a door for said hand receiving opening.

9. A unit according to claim 1, wherein said air flow means is a battery powered fan.

10. A unit according to claim 1, wherein said air flow means is an AC powered fan.

11. A unit according to claim 1, wherein said air flow means is an AC powered hot air blower.

12. A unit according to claim 1, wherein said receptacle is removable from said housing.

13. A unit according to claim 12, wherein said receptacle is slidably mounted in said housing for horizontally directed movement into and out of said housing.

14. A portable, self-contained hand washing and drying apparatus comprising:

an external housing, said housing including a pair of spaced side walls, a front wall, a rear wall, a removable top wall, and a bottom wall cooperating to enclose an upper compartment, a middle hand compartment, and a lower compartment;

said upper compartment including a cleansing liquid reservoir for storing no-rinse cleansing liquid, an electrically powered fan for selectively providing a flow of air within said hand compartment to dry hands received therein, and support means for mounting said cleansing liquid reservoir and said fan in said upper compartment, said support means being slidably mounted in said housing for horizontally directed movement into and out of said housing for enabling access to said cleansing liquid reservoir and said fan;

said hand compartment including a bottom drain board having a drain opening therein, said front wall including a hand-receiving opening communicating with said hand wash compartment;

said lower compartment including a removable waste liquid receptacle for storing used cleaning liquid; and means for selectively delivering cleansing liquid from said reservoir to said hand wash compartment.

* * * * *